United States Patent [19]

Fuseya et al.

[11] 4,295,953

[45] Oct. 20, 1981

[54] FILTER PRESS TYPE ION EXCHANGE MEMBRANE-METHOD ELECTROLYSIS CELL

[75] Inventors: Shigeaki Fuseya, Gifu; Teruo Ichisaka, Tamano, both of Japan

[73] Assignee: Chlorine Engineers Corp., Ltd., Tokyo, Japan

[21] Appl. No.: 109,029

[22] Filed: Jan. 2, 1980

[51] Int. Cl.[3] ..... C25B 9/00; C25B 15/08

[52] U.S. Cl. ..... 204/257; 204/263; 204/279

[58] Field of Search ..... 204/252–258, 204/263–266, 279, 286

[56] References Cited

U.S. PATENT DOCUMENTS

| | | | |
|---|---|---|---|
| 1,368,206 | 2/1921 | Burdett | 204/286 X |
| 2,161,166 | 6/1939 | Hunter | 204/258 |
| 4,069,128 | 1/1978 | Westerlund | 204/258 |
| 4,111,779 | 9/1978 | Seko et al. | 204/255 |
| 4,149,952 | 4/1979 | Sato et al. | 204/266 X |
| 4,211,627 | 7/1980 | Cunningham | 204/252 |

FOREIGN PATENT DOCUMENTS

| | | | |
|---|---|---|---|
| 2821984 | 11/1979 | Fed. Rep. of Germany | 204/255 |
| 2023181 | 12/1979 | United Kingdom | 204/252 |

*Primary Examiner*—Donald R. Valentine
*Attorney, Agent, or Firm*—Sughrue, Mion, Zinn, Macpeak and Seas

[57] ABSTRACT

A filter-press type ion exchange membrane-method electrolysis cell comprising (a) an anode structure which comprises a rectangular anode frame including a top element, a bottom element and two side elements and anode plates welded to the anode frame, (b) a cathode structure which comprises a rectangular cathode frame including a top element, a bottom element and two side elements and cathode plates welded to the cathode frame, and (c) an ion exchange membrane interposed between the anode structure and the cathode structure;

wherein the two side elements of the anode frame and the two side elements of the cathode frame have a tubular structure with a rectangular cross section, the top and bottom elements of the anode frame and the top and bottom elements of the cathode frame have a ]-shaped cross section, and are secured such that their open portions face the inside of an anode compartment and a cathode compartment, respectively, and at least one end of the top element of the anode frame communicates with the top end of the side element of the anode frame and at least one end of the top element of the cathode frame communicates with the top end of the side element of the cathode frame so that the side element communicating with the top element of the anode frame, and the side element communicating with the top element of the cathode frame form conduits for withdrawing gas and solution flowing from the anode compartment and the cathode compartment, respectively, (d) a current disperser surrounding an anode lead bar welded to anode plates within the anode structure and a current disperser surrounding a cathode lead bar welded to cathode plates within the cathode structure, whereby a region not permitting passage of gas is formed between the periphery of the anode lead bar and the inside of the current disperser welded to the anode plates and between the periphery of the cathode lead bar and the inside of the current disperser welded to the cathode plates, thus serving as a passage for a downwardly moving stream of electrolytic solution, and (e) a pipe for supplying an anolyte solution disposed within the anode compartment and a pipe for supplying a catholyte solution disposed within the cathode compartment.

2 Claims, 4 Drawing Figures

FILTER PRESS TYPE ION EXCHANGE MEMBRANE-METHOD ELECTROLYSIS CELL

BACKGROUND OF THE INVENTION

1. Field of the Invention

This invention relates to a filter press type ion exchange membrane-method electrolysis cell used, for example, in the electrolysis of alkali metal halides.

2. Description of the Prior Art

In a conventional filter press type ion exchange membrane-method electrolysis cell, the piping system is complicated because the pipe for withdrawing electrolytic solution and gas generated during electrolysis is secured to each electrolysis compartment from the outside through an electrode frame in each electrode structure. This causes a great deal of difficulty in installing or repairing the electrolysis cell.

In an attempt to overcome this difficulty, U.S. Pat. No. 4,069,129 suggests a filter press type electrolysis cell in which a top portion and a bottom portion of an electrode frame are constructed as hollow bodies so that the bottom hollow portion is used as a pipe for introduction of electrolytic solution and the electrolytic solution and gas generated during electrolysis are discharged from the top hollow portion.

In the electrolysis cell disclosed in U.S. Pat. No. 4,069,129, an outlet for gas generated during electrolysis and electrolytic solution is located in the top hollow portion of the electrode frame, and therefore, it is necessary to provide at the side portion of the electrolysis cell a piping system for withdrawing the gas generated during electrolysis and the electrolytic solution. Thus, the problem of piping is not improved very much as compared with the conventional electrolysis cell.

U.S. Pat. No. 4,069,129 further discloses that it is desirable to use a hollow structure as the side portion of the electrode frame, and use the hollow side portion for circulation of electrolytic solution (see column 3, lines 3 et seq. of U.S. Pat. No. 4,069,129). Circulation of electrolytic solution at both side portions, however, is not sufficient, and uniform circulation of the entire electrolytic solution is not obtained.

SUMMARY OF THE INVENTION

An object of this invention is to provide an improvement in and relating to a filter press-type electrolysis cell, and to provide an electrolysis cell which has a reduced number of pipes and is easy to build and maintain, and which permits sufficient circulation of the electrolytic solution within the electrode compartment.

The object of this invention is achieved by a filter press type ion exchange membrane-method electrolysis cell comprising (a) an anode structure which comprises a rectangular anode frame including a top element, a bottom element and two side elements and anode plates welded to the anode frame, (b) a cathode structure which comprises a rectangular cathode frame including a top element, a bottom element and two side elements and cathode plates welded to the cathode frame, and (c) an ion exchange membrane interposed between the anode structure and the cathode structure;

wherein the two side elements of the anode frame and the two side elements of the cathode frame have a tubular structure with a rectangular cross section, the top and bottom elements of the anode frame and the top and bottom elements of the cathode frame have a ]-shaped cross section, and are secured such that their open portions face the inside of an anode compartment and a cathode compartment, respectively, and at least one end of the top element of the anode frame communicates with the top end of the side element of the anode frame and at least one end of the top element of the cathode frame communicates with the top end of the side element of the cathode frame so that the side element communicating with the top element of the anode frame, and the side element communicating with the top element of the cathode frame form conduits for withdrawing gas and solution flowing from the anode compartment and the cathode compartment, respectively, (d) a current disperser surrounding an anode lead bar welded to both anode plates within the anode structure and a current disperser surrounding a cathode lead bar welded to both cathode plates within the cathode structure, whereby a region not permitting passage of gas is formed between the periphery of the anode lead bar and the inside of the current disperser welded to the anode plates and between the periphery of the cathode lead bar and the inside of the current disperser welded to the cathode plates, thus serving as a passage for a downwardly moving stream of electrolytic solution, and (e) a pipe for supplying an anolyte solution disposed within the anode compartment and a pipe for supplying a catholyte solution disposed within the cathode compartment.

BRIEF DESCRIPTION OF THE ACCOMPANYING DRAWINGS

Figure 1:
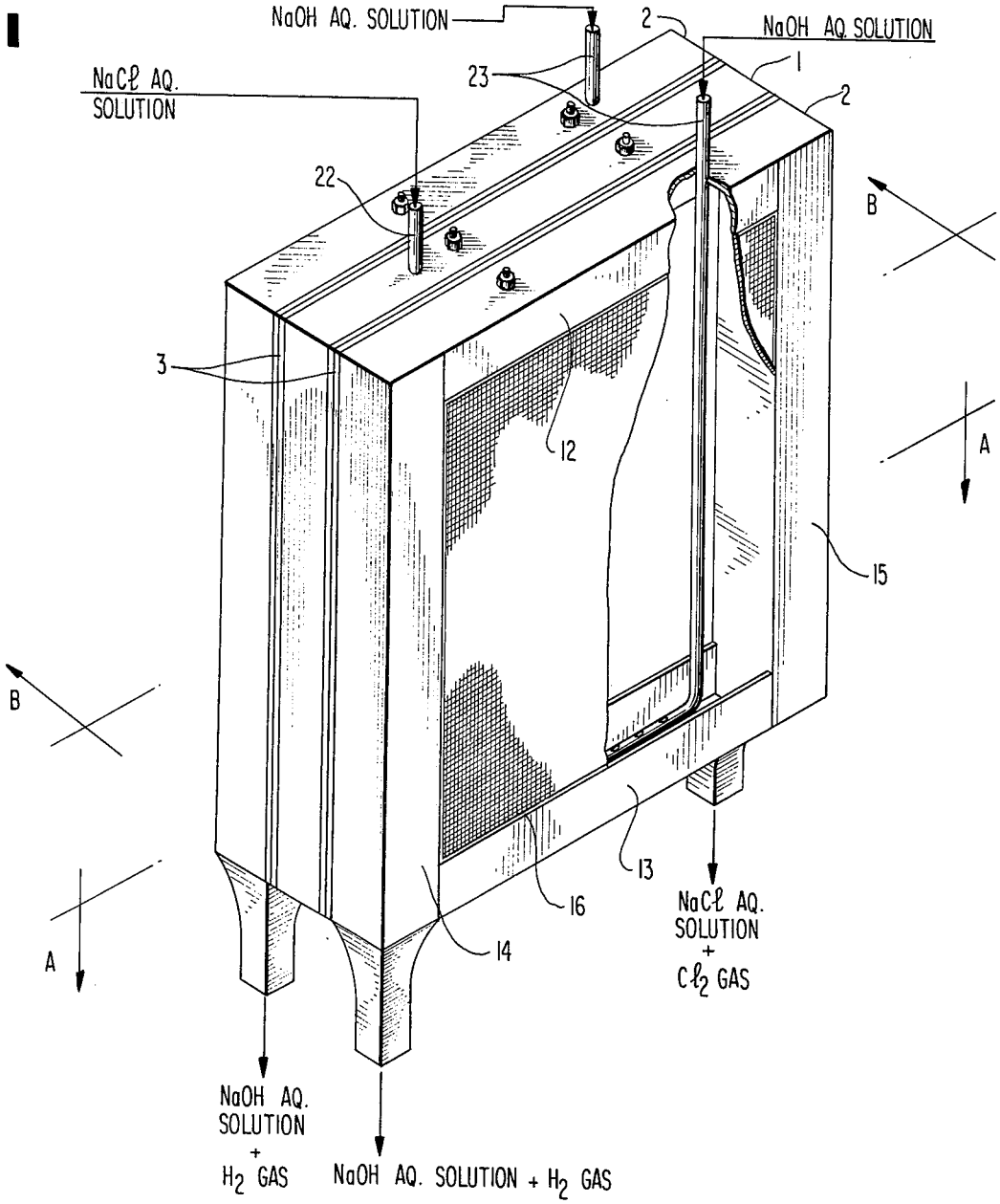
FIG. 1 is a perspective view of a part of a filter-press type ion exchange membrane-method electrolysis cell which is one embodiment of this invention.

In these drawings, 1 is an anode structure; 2, a cathode structure; 3, a cation exchange membrane; 4, a top element of the anode frame; 5, a bottom element of the anode frame; 6, 7, side elements of the anode frame; 8, an anode plate; 9, an anode lead bar; 10, a current disperser; 11, a communicating opening; 12, a top element of the cathode frame; 13, a bottom element of the cathode frame; 14, 15, side elements of the cathode frame; 16, a cathode plate; 17, a cathode lead bar; 18, a current disperser; 19, a communicating opening; 20, 21, regions not permitting passage of the generated gas; 22, a pipe for supplying an anolyte solution; and 23, a pipe for supplying a catholyte solution.

DETAILED DESCRIPTION OF THE INVENTION

The present invention is described below in detail with reference to the accompanying drawings wherein, in the drawings, the reference numeral 1 represents an anode structure and 2, a cathode structure, and a cation exchange membrane 3 is interposed between the anode structure 1 and the cathode structure 2. The anode structure 1 comprises a rectangular frame composed of a top element 4, a bottom element 5 and two side elements 6 and 7, and anode plates 8 welded to the anode frame. A current disperser 10 surrounding an anode lead bar 9 is welded to the anode plates 8. The top element 4 and the bottom element 5 of the anode frame have a ]-shaped cross section, and are secured such that their open surfaces face the inside of an anode compartment. The side elements 6 and 7 of the anode frame both have a tubular structure of a rectangular cross section. One end of the top element 4 communicates with the top end of the side element 6 at the part where they are welded together through a communicating opening 11. The side element 6 of the anode frame serves as a pipe for withdrawing solution and gas flowing from the anode compartment. The other side element 7 is a closed tubular body.

The cathode structure 2 comprises a rectangular cathode frame composed of a top element 12, a bottom element 13 and two side elements 14 and 15 and cathode plates 16 welded to the cathode frame. A current disperser 18 surrounding a cathode lead bar 17 is welded to the cathode plates 16. Both the top element 12 and the bottom element 13 have a ]-shaped cross section, and are secured so that their open surfaces face the inside of a cathode compartment. The side elements 14 and 15 of the cathode frame have a tubular structure with a rectangular cross section. One end of the top element 12 communicates with the top end of the side element 14 at the part where they are welded together through a communicating opening 19. The side element 14 serves as a pipe for withdrawing solution and gas flowing from the cathode compartment. The other side element 15 is a closed tubular body.

In the inside of the anode structure 1, the current disperser 10 surrounds the anode lead bar 9 and is welded to the insides of the anode plates 8. The current disperser 10 forms a space into which gas generated at the anode plates 8 during electrolysis does not pass, between the periphery of the anode lead bar 9 and the inside of the current disperser 10. This space is a region 20 not permitting passage of gases. In operation, the electrolytic solution containing the gas generated has a low apparent specific gravity and becomes a rising stream, whereas the solution having a high specific gravity remaining after the discharge of the gas together with a part of the electrolytic solution forms a falling stream. The region 20 not permitting passage of gases becomes a passage for the falling stream of the electrolytic solution.

Likewise, in the cathode structure 2, the current disperser 18 surrounds the cathode lead bar 17, and is welded to the insides of the cathode plates 16. Thus region 21 not permitting passage of gases is formed between the periphery of the cathode lead bar 17 and the inside of the current disperser 18, and serves as a passage for a falling stream of the electrolytic solution.

A pipe 22 for the supply of an anolyte solution is provided extending from the top of the anode compartment toward the bottom of the anode compartment so that the anolyte solution is fed into the anode compartment from the bottom of the anode compartment. Likewise, a pipe 23 for the supply of a catholyte solution is provided extending from the top to the bottom of the cathode compartment so that the catholyte solution is fed into the cathode compartment from the bottom of the cathode compartment.

Figure 2:
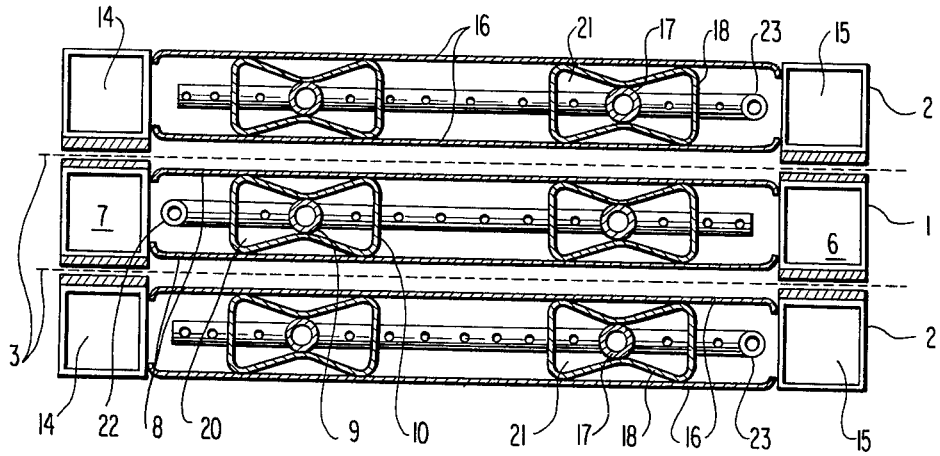
FIG. 2 is a cross-sectional view taken along the line A—A of FIG. 1.
Figure 3:
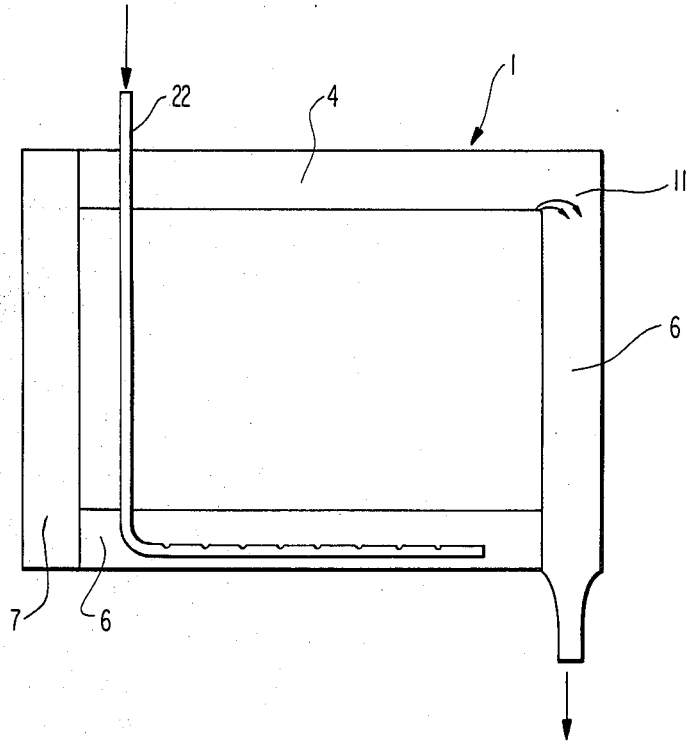
FIG. 3 is a longitudinal sectional view taken along the line B—B of the anode compartment of FIG. 1.
Figure 4:
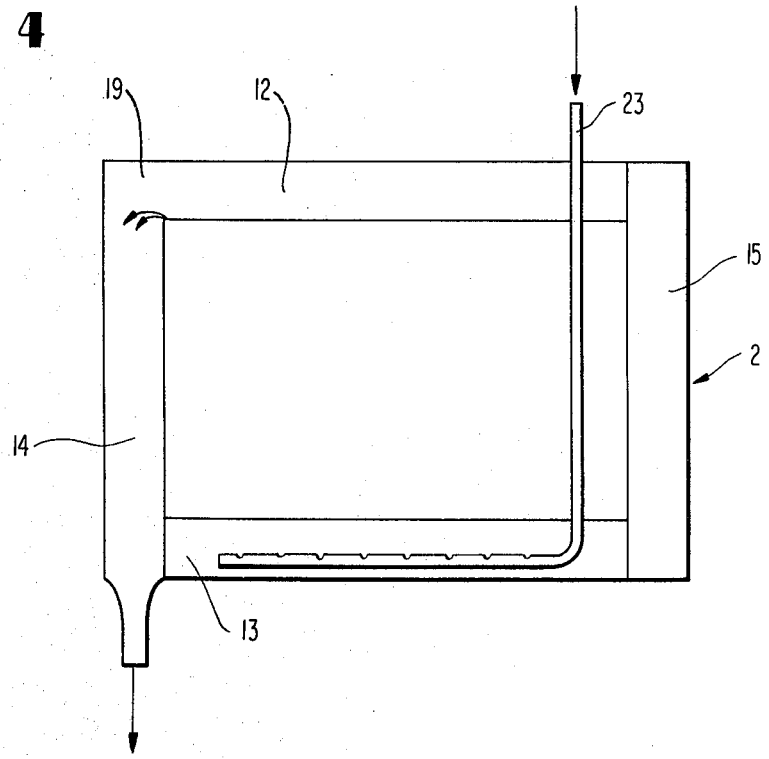
FIG. 4 is a longitudinal sectional view taken along the line B—B of the cathode compartment of FIG. 1.

In operation, when an aqueous solution of an alkali metal halide, for example, sodium chloride, is to be electrolyzed in the filter press type ion exchange membrane-method electrolysis cell shown in FIGS. 1 to 4, the aqueous sodium chloride solution is fed from the supply pipe 22 into the anode compartment, and chlorine gas generated at the anode plates 8 rises to the top element 4 of the anode frame together with the aqueous sodium chloride solution along the anode plates 8. Together with a part of the aqueous sodium chloride solution, the chlorine gas flows down through the side element 6 of the anode frame from the communicating opening 11 and is sent to a pipe (not shown) provided at the bottom of the electrolysis cell. The aqueous sodium chloride solution remaining after the removal of the chlorine gas flows down through the region 20 inwardly of the current disperser 10, and is circulated within the anode compartment. An aqueous solution of sodium hydroxide is fed into the cathode compartment through the pipe 23. Hydrogen gas generated on the cathode plates 16 rises to the top element 12 of the cathode frame together with the aqueous sodium hydroxide solution. Then, the hydrogen gas together with part of the aqueous sodium hydroxide solution flows through the side element 14 of the cathode frame from the communicating opening 19, and is sent to a pipe (not shown) provided at the bottom of the electrolysis cell. The aqueous sodium hydroxide solution left after the removal of hydrogen gas flows down the region 21 inwardly of the current disperser 18, and is circulated within the cathode compartment.

It is possible to use both side elements of the anode frame and both side elements of the cathode frame as pipes for withdrawing the electrolyte solution and gases generated. To simplify the piping at the bottom of the electrolysis cell, however, it is desirable that one of the side elements of the anode frame and one of the side elements of the cathode frame be used as pipes for withdrawal of the electrolytic solution and gas generated, and the other side element of the anode frame and the other side element of the cathode frame be used as closed pipes. Further, for simplification, the anode structure 1 and the cathode structure 2 should be arranged such that the side element, as a withdrawal pipe of the anode frame, adjoins the side element, as a closed pipe of the cathode frame, and the side element as a withdrawal pipe of the cathode frame adjoins the side element as a closed pipe of the anode frame.

If desired, a reinforcing material may be secured to the top and bottom elements with a ]-shaped cross section of the anode and cathode frames.

According to this invention, the side elements of the anode frame and the side elements of the cathode frame are used as pipes for the withdrawal of electrolytic solutions and gases generated. Thus, no piping exists in the side portions of the electrolysis cell and pipings exist only at the bottom of the electrolysis cell. Accordingly, the electrolysis cell is easy to build, and to maintain.

Furthermore, according to this invention, an area which does not permit the passage of gas generated is formed inwardly of each of the current disperser surrounding the anode lead bar and the current disperser surrounding the cathode lead bar. Since this region forms a passage for a downwardly moving stream of electrolytic solution, a convectional flow corresponding to the rising stream outwardly of the disperser is formed. Accordingly, this improves the circulation of the electrolytic solution within the anode structure and the cathode structure.

While the invention has been described in detail and with reference to specific embodiments thereof, it will be apparent to one skilled in the art that changes and modifications can be made therein without departing from the spirit and scope thereof.

What is claimed is:

1. A filter-press type ion exchange membrane-method electrolysis cell comprising (a) an anode structure which comprises a rectangular anode frame including a top element, a bottom element and two side elements and anode plates welded to the anode frame, (b) a cathode structure which comprises a rectangular cathode frame including a top element, a bottom element and two side elements and cathode plates welded to the cathode frame, and (c) an ion exchange membrane interposed between the anode structure and the cathode structure;

wherein the two side elements of the anode frame and the two side elements of the cathode frame have a tubular structure with a rectangular cross section, the top and bottom elements of the anode frame and the top and bottom elements of the cathode frame have a ]-shaped cross section, and are secured such that their open portions face the inside of an anode compartment and a cathode compartment, respectively, and at least one end of the top element of the anode frame communicates with the top end of the side element of the anode frame and at least one end of the top element of the cathode frame communicates with the top end of the side element of the cathode frame so that the side element communicating with the top element of the anode frame, and the side element communicating with the top element of the cathode frame form conduits for withdrawing gas and solution flowing from the anode compartment and the cathode compartment, respectively, (d) a current disperser surrounding an anode lead bar welded to anode plates within the anode structure and a current disperser surrounding a cathode lead bar welded to cathode plates within the cathode structure, whereby a region not permitting passage of gas is formed between the periphery of the anode lead bar and the inside of the current disperser welded to the anode plates and between the periphery of the cathode lead bar and the inside of the current disperser welded to the cathode plates, thus serving as a passage for a downwardly moving stream of electrolytic solution, and (e) a pipe for supplying an anolyte solution disposed within the anode compartment and a pipe for supplying a catholyte solution disposed within the cathode compartment.

2. The electrolysis cell as set forth in claim 1, wherein one of the side elements of the anode frame is a pipe for withdrawing gas and solution flowing from the anode compartment and the other side element of the anode frame is a closed pipe; one of the side elements of the cathode frame is a pipe for withdrawing gas and solution flowing from the cathode compartment and the other side element of the cathode frame is a closed pipe; and the anode structure and the cathode structure are arranged such that the side element as a withdrawal pipe of the anode frame adjoins the side element as a closed pipe of the cathode frame, and the side element as a withdrawal pipe of the cathode frame adjoins the side element as a closed pipe of the anode frame.

* * * * *